US005514227A

United States Patent [19]

Bodnar et al.

[11] Patent Number: 5,514,227

[45] Date of Patent: May 7, 1996

[54] METHOD OF PREPARING TITANIUM-BEARING LOW-COST STRUCTURAL STEEL

[75] Inventors: Richard L. Bodnar; Steven S. Hansen, both of Bethlehem, Pa.

[73] Assignee: Bethlehem Steel Corporation, Del.

[21] Appl. No.: 487,591

[22] Filed: Jun. 7, 1995

Related U.S. Application Data

[63] Continuation-in-part of Ser. No. 941,453, Sep. 8, 1992, Pat. No. 5,326,527, and Ser. No. 250,011, May 27, 1994.

[51] Int. Cl.[6] ..... C21D 8/02

[52] U.S. Cl. ..... 148/541; 148/547

[58] Field of Search ..... 148/541, 547

[56] References Cited

FOREIGN PATENT DOCUMENTS

| | | |
|---|---|---|
| 50-80911 | 11/1973 | Japan . |
| 61-23742 | 7/1984 | Japan . |
| 60-56024 | 4/1985 | Japan . |
| 62-120426 | 6/1987 | Japan . |
| 3-162522 | 7/1991 | Japan . |

OTHER PUBLICATIONS

Stanislaw Zajac et al., "Recrystallization Controlled Rolling and Accelerated Cooling for High Strength and Toughness in V–Ti–N Steels," *Met. Trans.*, vol. 22A, pp. 2681–2694 (1991).

J. S. Smaill et al., "Effect of titanium additions on strain–aging characteristics and mechanical properties of carbon–manganese reinforcing steels," *Metals Technology*, pp. 194–201 (1976).

L. A. Leduc et al., "Hot Rolling of C–Mn–Ti Steel," in *Thermomechanical Processing of Microalloyed Austenite*, pp. 641–654 (1982).

S. Ye, "Influence of Rolling and Cooling Process on Microstructure and Properties of C–Mn Steel Treated with Al–Ti–CaSi Combined Addition", *Iron steel (China)*, vol. 23(9), pp. 31–35 (1988).

Shyi–Chin Wang, "The Effect of Titanium and Nitrogen Contents on the Microstructure and Yield Streength of Plain Carbon Steels," *China Steel Technical Report*, No. 3, pp. 20–25 (1989).

F. B. Pickering, "Titanium nitride technology," in *Microalloyed Vanadium Steel*, pp. 79–95 (1990).

Tadeusz Siwecki et al., "Evolution of Microstructure During Recrystallization Controlled Rolling of HSLA Steels," in *Proc. of 33rd Mechanical Working and Steel Processing Conference* (Oct. 1991).

C. R. Killmore et al., "Titanium Treated C–Mn–Nb and C–Mn–V Heavy Structural Plate Steels with Improved Notch Toughness" (reference unknown).

ASTM Standard A572/A572M–88c, "Standard Specification for High–Strength Low–Alloy Columbium–Vanadium Steels of Structural Quality" (1988).

ASTM Standard A36/A36M–88c, "Standard Specification for Structural Steel" (1988).

ASTM Standard A529/A529M–88, "Standard Specification for Structural Steel with 42 ksi [290 MPa] Minimum Yield Point (½ in. [13 mm] Maximum Thickness" (1988).

*Primary Examiner*—Deborah Yee

[57] ABSTRACT

A fully killed steel has a composition that is tailored to meet a 50 KSI minimum yield strength after hot rolling and accelerated cooling. The steel has a carbon content in the range of from about 0.05 to about 0.10 percent or from about 0.15 to about 0.27 percent, from about 0.005 to about 0.020 percent titanium, from about 0.004 to about 0.015 percent nitrogen, from 0 to about 0.02 percent vanadium, and the remainder iron plus incidental impurities. The steel is continuously cast, hot rolled to plate, and cooled to a temperature of less than about 1100° F. at a cooling rate lying in a cooling rate band extending from about 2° to about 14° F./sec at 2 inches plate thickness, from about 7° to about 26° F./sec at 1 inch plate thickness, and from about 13° to about 45° F./sec at ½ inch plate thickness.

8 Claims, 1 Drawing Sheet

METHOD OF PREPARING TITANIUM-BEARING LOW-COST STRUCTURAL STEEL

This application is a continuation-in-part of application Ser. No. 07/941,453, filed Sep. 8, 1992, now U.S. Pat. No. 5,326,527, for which priority is claimed; and a continuation-in-part of pending application Ser. No. 08/250,011, filed May 27, 1994 for which priority is claimed.

BACKGROUND OF THE INVENTION

This invention relates to steels, and, more particularly, to a steel that achieves good structural properties with low alloying and production costs.

Low-alloy steels are iron-based metallic alloys, containing additional alloying elements in amounts of up to about 2 percent by weight, that are used in a wide variety of applications. Such steels typically have good mechanical and physical properties, generally low cost, and a high degree of versatility. Their properties can be varied over wide ranges by adjusting the alloying elements and processing of the steel to its final form.

The present invention deals with steels used in structural applications, such as plates. Such steels have medium levels of alloying elements that are, on the whole, relatively inexpensive. They are processed by casting and hot rolling, sometimes with accelerated cooling after rolling to improve the final mechanical properties. The properties of the final processed steel pieces depend upon their composition, processing, and final thickness. Thinner sections usually have properties superior to those of otherwise identical, but thicker, sections.

To improve the uniformity of specifying and obtaining steels, standards have been established for these and other types of steels by organizations such as the American Society for Testing and Materials (ASTM). In one example of interest here, ASTM Specification A572 sets forth the chemical and physical standards for steels that must achieve specified minimum yield strengths of 50 KSI in plate sections ranging from about ½ to 2 inch thick sections, termed the ASTM A572, Grade 50 standard. Structural designers utilize these standards in ordering steel from suppliers.

The various steel standards typically specify property levels that must be attained and maximum levels of alloying elements, but not minimum levels of alloying elements. A continuing effort by steelmakers is therefore to develop steels that meet the property requirements of the standards, but with reduced cost as a consequence of using reduced levels of the more expensive alloying elements. In particular, it would be desirable to develop a steel that meets ASTM A572 Grade 50 properties, but at lower costs than possible with the existing steels used for this grade. The present invention provides such steels, and their processing.

SUMMARY OF THE INVENTION

The present invention provides steels that meet the ASTM A572 standard for a minimum yield strength of 50,000 pounds per square inch (50 KSI) at a lower cost per ton than other steels used to meet this grade requirements. The steels are produced by continuous casting, hot rolling, and accelerated cooling at a rate achievable in existing commercial production facilities. These steels can be substituted for existing steels but with lower costs, and also provide improved competitiveness for steels as compared with competing materials such as reinforced concrete in many applications.

In accordance with the invention, a method for preparing a steel piece meeting the ASTM A572, Grade 50 standard comprises the step of furnishing a fully killed molten steel alloy consisting essentially of, in weight percent, a carbon content selected from the group consisting of from about 0.05 to about 0.10 percent and from about 0.15 to about 0.27 percent (most preferably a maximum of about 0.22 percent), from about 0.5 to about 1.50 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, from 0 to about 0.02 percent vanadium, and the remainder iron plus incidental impurities. The method includes continuously casting the molten steel alloy to produce a solid cast mass, hot rolling the solid cast mass to form a plate with a final thickness of no more than about 2 inches, and accelerated cooling the hot-rolled plate to a cooling stop temperature of less than about 1100° F. and more than about 900° F. The accelerated center cooling rate lies in a center cooling rate band extending from about 2° to about 14° F./sec at 2 inches plate thickness, from about 7° to about 26° F./sec at 1 inch plate thickness, and from about 13° to about 45° F./sec at ½ inch plate thickness. The plate is thereafter air cooled to a temperature below the bainite-start temperature, and typically to ambient temperature.

The steel composition can be even more precisely tailored according to the combination of steel composition and center cooling rate available at a particular commercial facility at any time. That is, during an extended continuous cast, the composition of the steel produced by the caster may vary with time. If the accelerated cooling rate of the steel can be varied over some range with the available equipment, that cooling rate may be controlled according to the composition of the steel reaching the accelerated cooling facility.

Thus, for example, if the center cooling rate lies in a slow accelerated center cooling rate band extending from about 2° to about 7° F./sec at 2 inches plate thickness, from about 7° to about 12° F./sec at 1 inch plate thickness, and from about 13° to about 21° F./sec at ½ inch plate thickness, the ASTM A572, Grade 50 standard may be met by a steel that contains carbon in an amount of from about 0.07 to about 0.10 percent carbon or from about 0.15 to about 0.17 percent carbon, about 0.012 percent titanium, about 0.012 percent nitrogen, and about 0.02 percent vanadium. Stated alternatively, if the steel reaching the cooling facility has the composition indicated, the slow accelerated cooling rate would be selected, if available at that facility.

If the center cooling rate lies in a medium accelerated center cooling rate band extending from about 7° to about 10° F./sec at 2 inches plate thickness, from about 12° to about 21° F./sec at 1 inch plate thickness, and from about 21° to about 5° F./sec at ½ inch plate thickness, the ASTM A572, Grade 50 standard may be met by a steel that contains carbon in an amount of from about 0.07 to about 0.10 percent carbon or from about 0.15 to about 0.17 percent carbon, about 0.012 percent titanium, about 0.008 percent nitrogen, and about 0.01 percent vanadium. Stated alternatively, if the steel reaching the cooling facility has the composition indicated, the medium accelerated cooling rate would be selected, if available at that facility.

If the center cooling rate lies in a high accelerated center cooling rate band extending from about 10° to about 14° F./sec at 2 inches plate thickness, from about 21° to about 26° F./sec at 1 inch plate thickness, and from about 35° to about 45° F./sec at ½ inch plate thickness, the ASTM A572, Grade 50 requirement may be met by a steel that contains from about 0.15 to about 0.17 percent carbon, about 0.012 percent titanium, no added nitrogen, and no vanadium. Stated alternatively, if the steel reaching the cooling facility has the composition indicated, the fast accelerated cooling rate would be selected, if available at that facility.

There is more than about 0.005 percent (and less than about 0.1 percent) aluminum to ensure that the steel is deoxidized to a "fully killed" state. The steel could be deoxidized and killed by other techniques, such as vacuum degassing. The steel may optionally contain other elements that do not interfere with the strengthening mechanism resulting from the presence of the titanium, nitrogen, and vanadium in the steel. For example, the steel may contain copper, preferably in an amount of from about 0.20 to about 0.50 percent by weight, to contribute to solid solution strengthening and to improve the corrosion resistance of the steel where that is required for the application.

The steel is processed by continuous casting and hot rolling. Continuous casting results in a uniform distribution of small titanium nitride particles in the steel. "Hot rolling" refers to rolling above the austenite recrystallization temperature. For the slab reheating temperature and range of thicknesses considered, hot rolling refers to rolling above 1500° F. After hot rolling, the steel is cooled at an accelerated center cooling rate consistent with the rates available at commercial facilities.

The carefully designed steel of the invention meets the ASTM A572, Grade 50 inexpensively and using commercially available continuous casting, hot rolling, and accelerated cooling facilities. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
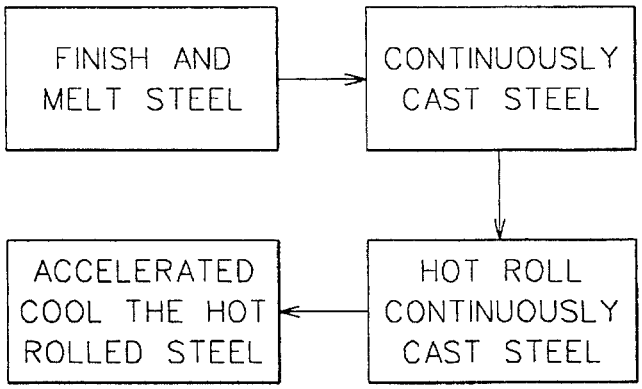
FIG. 1 is a block diagram for the process of the invention.

The steel of the invention has a composition of from about 0.05 to about 0.10 percent or from about 0.15 to about 0.27 percent carbon, from about 0.5 to about 1.50 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.0 15 percent nitrogen, from 0 to about 0.02 percent vanadium, and the remainder iron plus incidental impurities. (All compositions herein are in weight percent, unless indicated otherwise.)

If the carbon, manganese, or silicon contents are below the respective indicated levels, the steel does not achieve the strength requirements of the respective specification. If the carbon, manganese, or silicon contents are above the indicated levels, the steel exceeds the permitted levels of the respective specification and is therefore technically and commercially unacceptable.

The minimum carbon content for the ASTM A572 Grade 50 steel is about 0.05 percent. If the carbon content is less, it is not possible to achieve the required strength levels. The carbon content should not exceed about 0.27 percent, as the strength of the steel exceeds the commercial specification. The carbon content may not be between about 0.11 and about 0.14 percent. Steels with carbon content within this range are prone to surface cracking during continuous casting. This cracking is associated with the high-temperature peritectic reaction (liquid plus delta ferrite to produce austenite) during cooling. Steels containing less than about 0.10 and more than about 0.15 percent carbon are not subject to this cracking, because the peritectic reaction is limited to the range of about 0.11 to about 0.14 percent carbon. One particularly preferred carbon range is from about 0.07 to about 0.10 percent carbon, at the lower end of the lower acceptable range but avoiding the peritectic cracking. Another preferred carbon range is from about 0.15 to about 0.17 percent carbon, at the lower end of the upper acceptable range but still avoiding the peritectic cracking. The maximum carbon content is about 0.27 percent. However, a preferred maximum content is about 0.22 percent, at which carbon level acceptable ASTM A572, Grade 50 properties can be achieved with good toughness, when using the present processing approach.

The minimum manganese content is about 0.50 percent. If the manganese content is lower than this level, it is not possible to achieve the required strength, when the other elements are within their required ranges.

The maximum permissible manganese content is about 1.50 percent, above which value the strength of the steel exceeds the commercial specification. In a more preferred embodiment, the maximum manganese content of the steel is about 1.35 percent. A steel with a manganese content above about 1.35 percent has a tendency to exhibit manganese-related segregation in continuously cast product. That is, above about 1.35 percent manganese, a banded structure related to chemical segregation of the manganese is sometimes observed. One significant result of such an inhomogeneous structure is the formation of internal cracks in the frozen portion of the casting during the continuous casting process, which can fill with unsolidified material. These regions are subject to the formation of rolling defects during subsequent processing or premature failure during service. Thus, it is preferred that the maximum manganese content be limited to about 1.35 percent, in order to avoid any incidence of such manganese-related cracking in continuously cast product. Limiting the manganese content to about 1.35 percent also helps to hold the steel cost low.

The acceptable silicon content is from about 0.1 to about 0.4 percent. If the silicon content is less than about 0.1 percent, the resulting steel has insufficient strength. If the silicon content is above about 0.4 percent, the strength of the resulting steel is above the commercially acceptable range.

The titanium and nitrogen in the steel, when present, are intended to form titanium nitride particles of a size of about 20–60 nanometers that are dispersed throughout the steel and strengthen it by restricting austenite grain growth during processing. A small austenite grain size is desirable, as it leads to a small ferrite grain size in the final product, and the small ferrite grain size contributes to improved strength and toughness of the final product. If the titanium content is too low, an insufficient number of the titanium nitride particles are formed. If the titanium content is too high, coarse titanium nitride particles form in the liquid state. These coarse titanium nitride particles act as inclusions in the steel, degrading its toughness. The coarse titanium nitride particles also are not effective for restricting austenite grain growth during processing.

The lower limit of the nitrogen in the steel depends upon the processing to be used. Because the TiN particles are relatively stable at low nitrogen levels when reheating at temperatures of 2300° F. and less, a low level of about 0.004 percent nitrogen is sufficient to achieve the desired grain refinement necessary to meet the yield strength requirement. When the reheating temperature exceeds about 2300° F., some of the TiN particles can dissolve, and austenite grain growth occurs. Excess nitrogen is necessary to stabilize the TiN particles to ensure a fine grain size when using reheating temperatures from 2300° F. to 2500° F. or more.

Additional nitrogen may be provided in the steel above that required for titanium nitride formation. Nitrogen, along with manganese, silicon, and copper, when used, produces solid solution strengthening. Sufficient excess nitrogen is provided to react with vanadium, where provided, to permit the formation of vanadium carbonitrides, as will be discussed subsequently. Taking these other effects of nitrogen into account, the minimum nitrogen content has been established at about 0.004 percent. The nitrogen content should not exceed about 0.015 percent, as amounts of nitrogen exceeding 0.015 percent can cause the extensive precipitation of coarse titanium nitride particles in the liquid prior to casting. The coarse titanium nitride particles are retained into the solid state and final product, and may reduce the fracture toughness of the steel.

Vanadium, a relatively expensive element, is added to the steel sparingly and only as necessary to meet property requirements. The vanadium reacts with the carbon and nitrogen present in the steel to produce fine vanadium carbonitride particles on the order of about 3–10 nanometers in size that have a strong influence on the strength of the steel.

The steel is "fully killed", a well known steelmaking condition wherein the oxygen in the steel is removed. Excessive free oxygen may not be present in the steel, as it reacts with the titanium to form titanium oxide. The titanium is therefore not available to form the desired titanium nitride particulate. To fully kill the steel, the oxygen may be removed by vacuum processing, but is more economically removed by adding a strong oxide former such as aluminum. In the present steel, there is more than about 0.005 percent aluminum to ensure that the steel is deoxidized to a "fully killed" state. The maximum aluminum content is about 0.1 percent, as undesirable aluminides may form at higher aluminum contents.

The steel may optionally contain other elements that do not interfere with the strengthening mechanism resulting from the titanium, nitrogen, and vanadium in the steel. ASTM A572 permits the steel to contain copper for corrosion resistance. To be consistent with this requirement of the specification, the steel may contain copper, preferably in an amount of from about 0.20 percent to about 0.50 percent, to improve the corrosion resistance of the steel where that is required for the design application.

The remainder of the steel is iron and incidental elements that are often present in conventional steelmaking practice.

The steel according to the invention is melted according to conventional practice, numeral 20 of FIG. 1. In the preferred approach, the steel is melted in a basic oxygen furnace. Other steelmaking practices such as electric furnace and DC plasma arc are acceptable.

The steel is cast, numeral 22, at a cooling rate sufficient to produce a fine dispersion of titanium nitride particles throughout the steel upon solidification. In commercial practice, the steel is continuously cast with a slab, bloom, billet, or near-net-shape caster to produce a center solidification rate of at least about 5 degrees F. per minute.

The cast steel is reheated if necessary in a reheat furnace and then hot rolled using an acceptable hot rolling practice, numeral 24. The hot rolling procedure may be conventional practice wherein the temperature of the steel is not controlled. (The control-finish temperature "CFT") process, wherein the temperature of the steel is maintained such that it emerges from the final pass at a preselected temperature, is within the scope of "hot rolling" as that term is used herein). The final rolling temperature is above the austenite recrystallization temperature. The steel is hot rolled to a required section thickness. Thickness limitations to meet property requirements have been discussed previously in relation to the composition of the steel.

The steel is accelerated cooled, numeral 26. In general, the accelerated cooling produces structural changes that lead to improved strength with acceptable toughness, an absence of surface cracking, and an absence of plate distortion, for any particular composition in the ranges discussed herein. Thus, there is, on the face of the analysis, an incentive to accelerate cooling to a reasonably high rate. However, the cooling rate cannot be arbitrarily increased, because each production facility having the capability for accelerated cooling is limited by the available cooling equipment. The plate-line accelerated cooling equipment at each production facility is custom designed for that facility, and, accordingly, there is no fixed cooling rate that is achieved by all production facilities. Moreover, the cooling rate depends significantly on the final thickness of the as-hot-rolled plate provided to the accelerated cooling facility.

Figure 2:
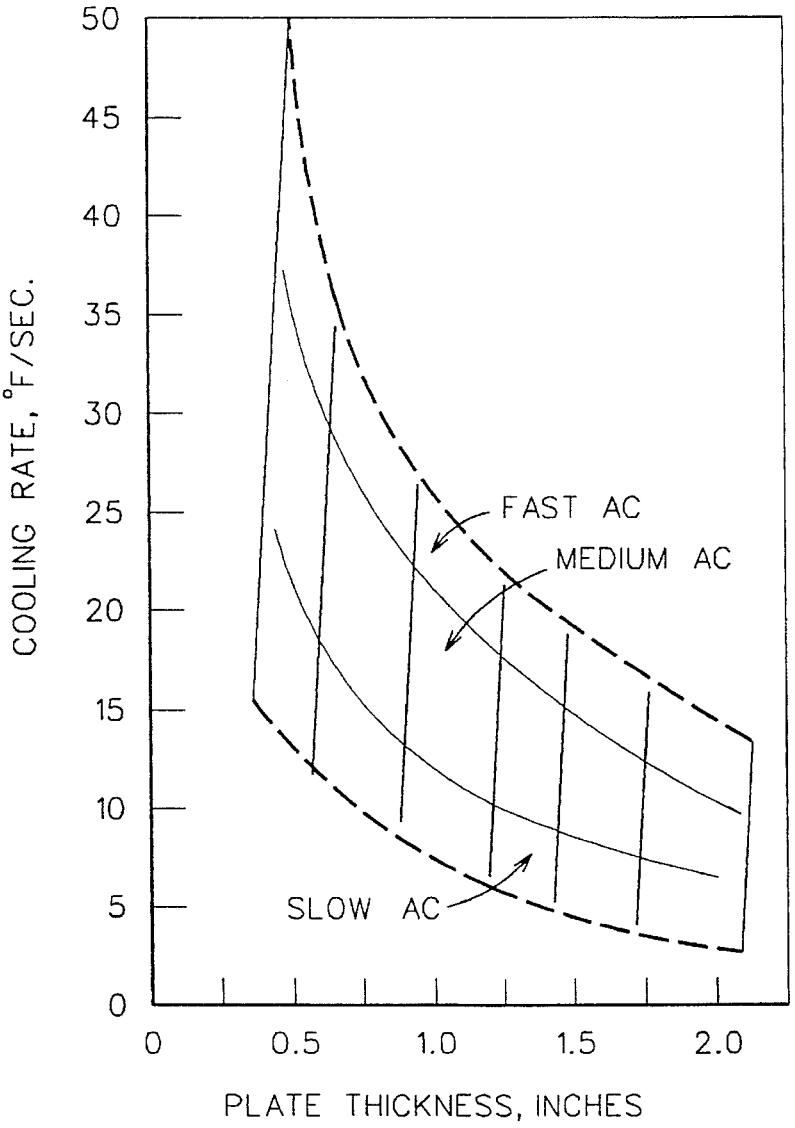
FIG. 2 is a graph of cooling rate as a function of plate thickness for commercial steelmaking facilities.

The inventors have studied data for accelerated cooling facilities at plate rolling mills throughout the world, and have developed FIG. 2. FIG. 2 depicts the center accelerated cooling (AC) rate for plates subjected to accelerated cooling at commercial plate production facilities of various major steel manufacturers, and thus provides an indication of the range of potential cooling rates available with commercial accelerated plate cooling equipment. The cooling rates are presented in a cooling rate band to reflect the effect of plate thickness and possible cooling severity.

With this in mind, the present invention has been further refined by defining fast, medium, and slow cooling rate bands within the broad scope of the available facilities. With this approach, it is possible to further refine the compositions of the steels. Thus, for example, if the center cooling rate lies in a slow accelerated center cooling rate band extending from about 2° to about 7° F./sec at 2 inches plate thickness, from about 7° to about 12° F./sec at 1 inch plate thickness, and from about 13° to about 21° F./sec at ½ inch plate thickness, the ASTM A572, Grade 50 standard may be met by a steel that contains carbon in an amount of from about 0.07 to about 0.10 percent carbon or from about 0.15 to about 0.17 percent carbon, about 0.012 percent titanium, about 0.012 percent nitrogen, and about 0.02 percent vanadium. Stated alternatively, if the steel reaching the cooling facility has the composition indicated, the slow accelerated cooling rate would be selected, if available at that facility. If the center cooling rate lies in a high accelerated center cooling rate band extending from about 7° to about 10° F./sec at 2 inches plate thickness, from about 12° to about 21° F./sec at 1 inch plate thickness, and from about 21° to about 35° F./sec at ½ inch plate thickness, the ASTM A572, Grade 50 standard may be met by a steel that contains carbon in an amount of from about 0.07 to about 0.10 percent carbon or from about 0.15 to about 0.17 percent carbon, about 0.012 percent titanium, about 0.008 percent nitrogen, and about 0.01 percent vanadium. Stated alternatively, if the steel reaching the cooling facility has the composition indicated, the medium accelerated cooling rate would be selected, if available at that facility. If the center cooling rate lies in a medium accelerated center cooling rate band extending from about 10° to about 14° F./sec at 2 inches plate thickness, from about 21° to about 26° F./sec at 1 inch plate thickness, and from about 35° to about 45° F./sec at ½ inch plate thickness, the ASTM A572, Grade 50 requirement may be met by a steel that contains from about 0.15 to about 0.17 percent carbon, about 0.012 percent titanium, no added nitrogen, and no vanadium. Stated alternatively, if the steel reaching the cooling facility has the composition indicated, the fast accelerated cooling rate would be selected, if available at that facility.

In the present processing approach, the steel is accelerated cooled to a temperature of less than about 1100° F., but preferably not less than about 900° F. Accelerated cooling to less than about 1100° F. lowers the temperature to less than the ferrite transformation temperature to produce a fine microstructure. However, if the steel is accelerated cooled to temperatures of less than about 900° F., bainite and martensite form, reducing the ductility and toughness of the final steel product. Accordingly, after accelerated cooling to the range of about 900° F. to about 1100° F., the steel is thereafter air cooled to below the bainite start temperature, and preferably to ambient temperature.

The effects of carbon content, manganese content, and nitrogen-vanadium alloying were studied in titanium-containing steels, and compared with a titanium-free baseline. The following Table 1 summarizes the steel compositions studied:

TABLE 1

| | Composition, wt. % | | | | |
|---|---|---|---|---|---|
| Grade | C | Mn | V | Ti | N |
| .10C–1.25Mn | 0.10 | 1.27 | <0.003 | 0.015 | 0.0071 |
| .10C–1.00Mn—VN | 0.11 | 0.98 | 0.020 | 0.015 | 0.0130 |
| .10C–1.25Mn—VN | 0.10 | 1.20 | 0.020 | 0.014 | 0.0120 |
| .10C–1.50Mn—VN | 0.09 | 1.47 | 0.020 | 0.013 | 0.0120 |
| .15C Base (No Ti) | 0.15 | 1.25 | <0.003 | 0.002 | 0.0056 |
| .15C Base (+Ti) | 0.16 | 1.26 | <0.003 | 0.014 | 0.0072 |
| .15C–1.25Mn | 0.16 | 1.26 | <0.003 | 0.014 | 0.0072 |
| .15C–1.25Mn—VN | 0.15 | 1.28 | 0.022 | 0.013 | 0.0120 |

In all cases, the phosphorus was about 0.014 –0.015 percent, the sulfur was about 0.011–0.012 percent, and the silicon was about 0.23 –0.24 percent. The remainder of the steel was iron with incidental impurities.

The steels were vacuum induction melted and cast as 500 pound ingots, each 8.5 inches square and 20 inches long. Prior studies have shown that the solidification of these test ingots approximates that of continuously cast material. Pieces of the ingots were reheated to 2300° F. and hot rolled to plate thicknesses of 0.5, 1.0, and 2.0 inches, with centerline thermocouples inserted. After hot rolling, the pieces were air cooled, or cooled at rates approximating the "Fast AC" or "Slow AC" center cooling bands of FIG. 2, to the range of 900° F.–1100° F. and thereafter air cooled to ambient temperature. The resulting plates were studied metallographically, with tensile and impact tests, and by grain coarsening tests.

From these and other tests, the conclusions as to composition and cooling relations disclosed herein were developed.

In summary, the steels of the invention provide an advance in the art of structural steels. Steels that meet the ASTM A572, Grade 50 specification can be produced less expensively than existing steels that meet the specifications, by carefully adjusting the additions of further alloying elements to conventional steels. Although a particular embodiment of the invention has been described in detail for purposes of illustration, various modifications may be made without departing from the spirit and scope of the invention. Accordingly, the invention is not to be limited except as by the appended claims.

What is claimed is:

1. A method for preparing a steel piece, comprising the steps of:

furnishing a fully killed molten steel alloy consisting essentially of, in weight percent, a carbon content selected from the group consisting of from about 0.05 to about 0.10 percent and from about 0.15 to about 0.27 percent, from about 0.5 to about 1.50 percent manganese, less than about 0.04 percent phosphorus, less than about 0.05 percent sulfur, from about 0.1 to about 0.4 percent silicon, from about 0.005 to about 0.020 percent titanium, from about 0.004 to about 0.015 percent nitrogen, from 0 to about 0.02 percent vanadium, and the remainder iron plus incidental impurities;

continuously casting the molten steel alloy to produce a solid cast mass;

hot rolling the solid cast mass to form a plate with a final thickness of no more than about 2 inches; and cooling the hot-rolled plate to a temperature of less than about 1100° F. but more than about 900° F. at an accelerated cooling rate lying in a cooling rate band extending from about 2° to about 14° F./sec at 2 inches plate thickness, from about 7° to about 26° F./sec at 1 inch plate thickness, and from about 13° to about 45° F./sec at ½ inch plate thickness, and thereafter air cooling the plate.

2. The method of claim 1, wherein the step of cooling includes the step of cooling the hot-rolled plate to a temperature of less than about 1100° F. at a cooling rate lying in a cooling rate band extending from about 2° to about 7° F./sec at 2 inches plate thickness, frown about 7° to about 12° F./sec at 1 inch plate thickness, and from about 13° to about 21° F./sec at ½ inch plate thickness, and wherein the step of providing includes the step of providing a molten steel alloy that contains carbon in an amount selected from the group consisting of from about 0.07 to about 0.10 percent carbon and from about 0.15 to about 0.17 percent carbon, about 0.012 percent titanium, about 0.012 percent nitrogen, and about 0.02 percent vanadium.

3. The method of claim 1, wherein the step of cooling includes the step of cooling the hot-rolled plate to a temperature of less than about 1100° F. at a cooling rate lying in a cooling rate band extending from about 7° to about 10° F./sec at 2 inches plate thickness, from about 12° to about 21° F./sec at 1 inch plate thickness, and from about 21° to about 35° F./sec at ½ inch plate thickness, and wherein the step of providing includes the step of providing a molten steel alloy that contains carbon in an amount selected from the group consisting of from about 0.07 to about 0.10 percent carbon and from about 0.15 to about 0.17 percent carbon, about 0.012 percent titanium, about 0.008 percent nitrogen, and about 0.01 percent vanadium.

4. The method of claim 1, wherein the step of cooling includes the step of cooling the hot-rolled plate to a temperature of less than about 1100° F. at a cooling rate lying in a cooling rate band extending from about 10° to about 14° F./sec at 2 inches plate thickness, from about 21° to about 26° F./sec at 1 inch plate thickness, and from about 35° to about 45° F./sec at ½ inch plate thickness, and wherein the step of providing includes the step of providing a molten steel alloy that contains carbon in an amount of from about 0.15 to about 0.17 percent carbon, about 0.012 percent titanium, no added nitrogen, and no vanadium.

5. The method of claim 1, wherein the step of furnishing includes the step of providing a molten steel alloy that contains from about 0.5 to about 1.35 percent manganese.

6. The method of claim 1, wherein the step of furnishing includes the step of providing a molten steel alloy that contains from about 0.2 percent to about 0.5 percent copper.

7. The method of claim 7, wherein the step of hot rolling includes the step of hot rolling the solid cast mass to form a plate with a final thickness of from about ½ inch to about 2 inches.

8. The method of claim 1, wherein the step of furnishing includes the step of providing a molten steel alloy that contains a maximum of about 0.22 percent carbon.

* * * * *